US006317559B1

(12) United States Patent
Kim

(10) Patent No.: US 6,317,559 B1
(45) Date of Patent: Nov. 13, 2001

(54) APPARATUS FOR SEALING THE END PORTION OF A HOT-WATER TUBE IN WHICH ELECTRIC HEATING WIRES ARE INSERTED

(76) Inventor: Du Nyun Kim, Woosung Green Bill 102-101, 687-1, Pungduckcheonre, Sujiup, Yongin (KR), 449-840

( * ) Notice: Subject to any disclaimer, the term of this patent is extended or adjusted under 35 U.S.C. 154(b) by 0 days.

(21) Appl. No.: 09/662,721

(22) Filed: Sep. 15, 2000

(30) Foreign Application Priority Data

Sep. 15, 1999 (KR) ..... 99-19789

(51) Int. Cl.[7] ..... F22B 29/06

(52) U.S. Cl. ..... 392/398; 392/455; 392/501; 392/489

(58) Field of Search ..... 392/398, 448, 392/455, 501, 480, 481, 488, 489, 491, 492, 494, 503; 219/213, 476, 478, 523, 536, 553

(56) References Cited

U.S. PATENT DOCUMENTS

| | | | | |
|---|---|---|---|---|
| 1,905,343 | | 4/1933 | Carpenter . | |
| 3,079,673 | | 3/1963 | Loehlein et al. . | |
| 3,970,816 | * | 7/1976 | Hosokawa et al. | 219/523 |
| 4,848,616 | * | 7/1989 | Nozaki | 392/501 |
| 5,109,474 | * | 4/1992 | Cameron | 392/501 |
| 5,159,659 | * | 10/1992 | Cameron | 392/501 |
| 5,191,634 | * | 3/1993 | Couch | 392/501 |
| 5,305,419 | * | 4/1994 | Cameron | 392/501 |
| 5,828,810 | * | 10/1998 | Frank et al. | 392/501 |
| 5,834,741 | * | 11/1998 | Tseng | 392/501 |
| 5,905,849 | * | 5/1999 | Ito | 219/523 |
| 5,915,072 | * | 6/1999 | Campbell et al. | 219/553 |
| 6,118,934 | * | 9/2000 | Tseng | 392/503 |
| 6,151,448 | * | 11/2000 | Reusche et al. | 392/501 |

FOREIGN PATENT DOCUMENTS 0743492 11/1996 (EP) .

* cited by examiner

*Primary Examiner*—Teresa Walberg
*Assistant Examiner*—Fadi H. Dahbour
(74) *Attorney, Agent, or Firm*—James Creighton Wray; Meera P. Narasimhan

(57) ABSTRACT

An apparatus for sealing an end portion of a hot-water tube in which electric heating wires are inserted enables electric heating wires in hot-water tubes to extend through to the outside, while preventing leakage of water from the hot-water tubes. A plug (3) is screw-connected to the end portion (1*a*) of a hot-water tube (1). A silicone cock (4) of an elastic material, through which coated electric heating wires (2) of the hot-water tube are placed, is inserted into the cylinder-like concave (3*b*) of the plug (3). A crown nut (5) is screwed onto the plug (3), pressing the cock (4) to enhance the water-tightness of the end portion of the hot-water tube and to allow the electric heating wires to be placed effectively from inside to the outside of the hot-water tube.

1 Claim, 1 Drawing Sheet

APPARATUS FOR SEALING THE END PORTION OF A HOT-WATER TUBE IN WHICH ELECTRIC HEATING WIRES ARE INSERTED

BACKGROUND OF THE INVENTION

1. Field of the Invention

The present invention relates to an apparatus for sealing the end portion of a hot-water tube in which electric heating wires are inserted, characterized in that it enables electric heating wires in hot-water tube to extend through to the outside without the leakage of water from the hot-water tube.

2. Description of the Prior Art

In conventional boilers, there is no fear for leakage of water in heating a room by supplying heated water to a room-heating hot-water tube, because the hot-water tube is tube-connected with-the boiler.

According to a conventional method, in inserting an electric heating, wire through the entire length of a room-heating hot-water tube and connecting both ends of said wire to a power source by extending said wire out through both ends of the hot-water tube, each end of the hot-water tube was closed by a plug and a hole through which the wire passes was sealed off with an adhesive agent to prevent leakage of water. (Refer to U.S. Pat. No. 5,832,179 by Kim et al titled FLOOR HEATER WITH WATER TUBE AND THIN COPPER ELECTRIC HEATING ELEMENT INSERTED THEREIN)

This conventional method of sealing the ends of a hot-water tube with an adhesive agent offered a problem because the adhesive agent fell off when the inner pressure inside the hot-water tube rose, when the electric heating wire is pulled or moved sideways, resulting in a leakage of water through the hole through which the wire is placed.

SUMMARY OF THE INVENTION

In the present invention, in order to solve the above problem, a plug is screw-connected to each end of the room-heating hot-water tube, a silicone cock of an elastic material, through which coated electric heating wires are placed from the hot-water tube to the outside of the tube, is inserted into the cylinder-like concave of the plug. Then a crown nut is screwed in onto the exterior of the plug, pressing down the cock. This pressing down the cock results in tight sealing of the clearance between the plug and the cock and of the clearance in the holes through which the electric heating wires pass, preventing leakage of water and tottering of the wire in the cock. This promotes safe installation of a room-heating apparatus and expediency in room-heating.

Figure 1:
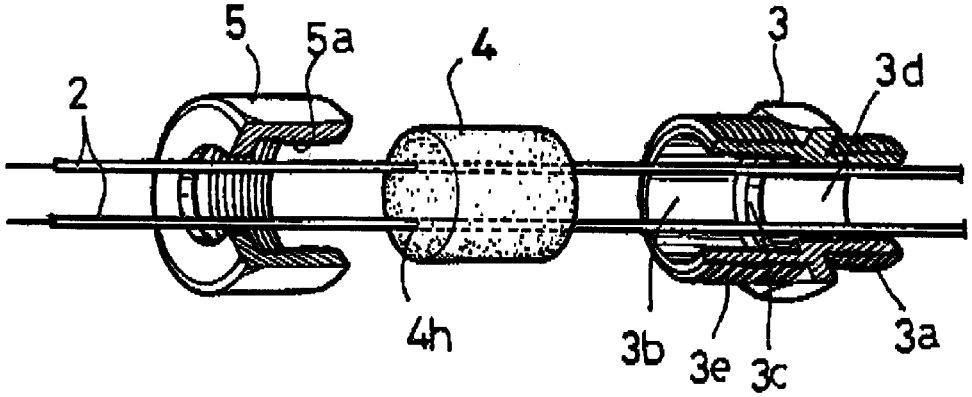
FIG. 1 shows an exploded partially cutaway view of the invention.
Figure 2:
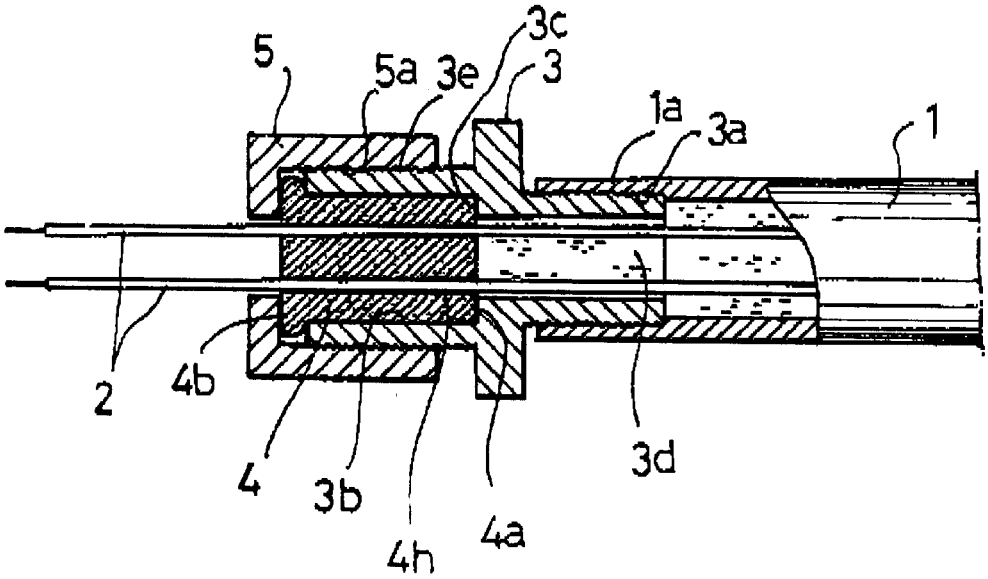
FIG. 2 shows a combined sectional view of the invention. Explanation of the codes used for key portions of the drawings

1: hot-water tube
2: coated electric heating wire
3: plug
4: silicone cock
5: crown nut

DETAILED DESCRIPTION OF PREFERRED EMBODIMENTS

In a room-heating hot-water tube (1) into which coated electric heating wires (2) are inserted throughout the entire length of said hot-water tube, said heating wires passing through both end portions (2) of the tube, and a tube connector (3*a*) of the plug (3) having a hole (3*d*) is inserted into and screw-connected with each of the two end portions (1*a*) of the hot-water tube (1). Then a silicone cock (4) of an elastic material, through which electric heating wires (2) of the hot-water tube (1) pass via holes (4*h*) is inserted into the cylinder-like concave (3*b*) of the plug (3) so that the inner end (4*a*) of the cock (4) may reach the inner jaw (3*c*) of the plug (3). Then the screwed portion (5*a*) of a crown nut (5) is screwed in from the outer end portion (4*b*) of the cock (4), which has a small protrusion to the outer end of the plug (3), onto the screwed portion (3*e*) of the plug (3), thereby pressing and sealing the cock (4) tightly.

In this way, under the present invention, before a cock (4) is sealed within a plug (3), water is filled in a hot-water tube (1)via a hole (3*d*) of the plug (3), then coated electric heating wires (2) are placed through the holes (4*h*) of the cock (4), then the silicone cock (4) is inserted into a cylinder-like concave (3*b*) of the plug (3), and then a crown nut (5) is screwed in onto the outside of the plug.

The more the crown nut (5) is screwed in, the more tightly the inner end portion (4*a*) and the outer end portion (4*b*) of the silicone cock (4) of an elastic material is compressed between the inner jaw (3*c*) of the plug (3) and the inside of the crown nut (5). This not only seals the hole (3*d*) of the plug (3) tightly but also compresses and tightly seals the holes (4*h*) of the cock (4), through which the electric heating wires (2) pass, and fixes the electric heating wires stably.

Under the present invention, a tube-connecting portion of a plug is connected to the end portions of a hot-water tube, then a silicone cock of an elastic material, through which electric heating wires of the hot-water tube pass is inserted, and a crown nut is screwed in, This entire operation is simple and convenient and brings forth excellent sealing effect and prevention of water leakage. The electric heating wires are firmly fixed in the cock without tottering even when they are pulled. The present invention thus fulfills all the desired effects of sealing off the water in the hot-water tube, preventing water leakage, and stable fixing of electric heating wires.

The construction of the present invention can also be applied to the prevention of freezing of oil pipe and water-supply pipe during the winter.

I claim:

1. An apparatus for sealing end portions of a hot-water tube (1) into an entire length of which coated electric heating wires (2) are inserted, comprising a tube connector portion (3*a*) of a plug (3) having a hole (3*d*) connected to each end portion (1*a*) of the hot-water tube (1), a silicone cock (4) of an elastic material through which coated electric heating wires (2) of the hot-water tube (1) are placed via holes (4*h*) is inserted into a cylinder-like concave (3*b*) of said plug so that said cock may reach a jaw (3*c*) of said concave (3*b*), and a first screw portion on a crown nut and a second screw portion on the plug wherein the first screw portion (5*a*) of the crown nut (5) is screwed in onto the second screw portion (3*e*) of said plug (3) to maintain the functions of water leakage prevention and fixing of said electric heating wires.

* * * * *